US009431769B2

(12) United States Patent
Gao et al.

(10) Patent No.: US 9,431,769 B2
(45) Date of Patent: Aug. 30, 2016

(54) ELECTRICAL CONNECTOR HAVING IMPROVED SHIELDING

(71) Applicant: HON HAI PRECISION INDUSTRY CO., LTD., New Taipei (TW)

(72) Inventors: Sheng-Pin Gao, Kunshan (CN); Zhi-Cheng Zhang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 2 days.

(21) Appl. No.: 14/287,682

(22) Filed: May 27, 2014

(65) Prior Publication Data

US 2014/0349519 A1 Nov. 27, 2014

(30) Foreign Application Priority Data

May 27, 2013 (CN) ..... 2013 2 02940135 U

(51) Int. Cl.

| | |
|---|---|
| ***H01R 13/648*** | (2006.01) |
| *H01R 12/72* | (2011.01) |
| *H01R 13/518* | (2006.01) |
| *H01R 13/658* | (2011.01) |
| *H01R 12/50* | (2011.01) |
| *H01R 12/71* | (2011.01) |
| *H01R 13/514* | (2006.01) |
| *H01R 13/6587* | (2011.01) |
| *H01R 13/66* | (2006.01) |
| *H01R 24/64* | (2011.01) |

(52) U.S. Cl.

CPC ..... *H01R 13/648* (2013.01); *H01R 12/716* (2013.01); *H01R 12/727* (2013.01); *H01R 13/514* (2013.01); *H01R 13/518* (2013.01); *H01R 13/658* (2013.01); *H01R 13/6587* (2013.01); *H01R 13/6658* (2013.01); *H01R 23/6873* (2013.01); *H01R 24/64* (2013.01)

(58) Field of Classification Search

CPC ..... H01R 12/716; H01R 13/514; H01R 13/6658; H01R 13/518; H01R 23/6873; H01R 12/727; H01R 13/658

USPC ..... 439/607.01, 541.5

See application file for complete search history.

(56) References Cited

U.S. PATENT DOCUMENTS

| | | | | |
|---|---|---|---|---|
| 6,736,673 | B1 | 5/2004 | Simmons et al. | |
| 7,033,210 | B1 | 4/2006 | Laurer et al. | |
| 8,011,950 | B2 | 9/2011 | McGrath et al. | |
| 8,579,661 | B2 * | 11/2013 | Zhang | H01R 13/6587 439/540.1 |
| 2012/0142199 | A1 * | 6/2012 | Purkis | H01R 24/64 439/39 |
| 2012/0196478 | A1 * | 8/2012 | Zhang | H01R 13/514 439/607.01 |

* cited by examiner

*Primary Examiner* — Abdullah Riyami
*Assistant Examiner* — Justin Kratt
(74) *Attorney, Agent, or Firm* — Ming Chieh Chang; Wei Te Chung

(57) ABSTRACT

An electrical connector includes: a shielding shell; an insulative housing received in the shielding shell, the insulative housing having two rows of mating ports in a vertical direction and a receiving slot between the two rows of mating ports; a contact module mounted in the insulative housing, the contact modules comprising an inner circuit board and a plurality of mating contacts mounted on an upper surface and a lower surface of the inner circuit board, the inner circuit board comprising a conductive area at a front end thereof; and a conductive foam received in the receiving slot and compressed between the conductive area of the inner circuit board and the shielding shell.

17 Claims, 7 Drawing Sheets

ELECTRICAL CONNECTOR HAVING IMPROVED SHIELDING

BACKGROUND OF THE INVENTION

1. Field of the Invention

The present invention relates to an electrical connector and especially relates to a shielding structure thereof.

2. Description of Related Art

U.S. Publication No. 2012/0196478 discloses an electrical connector comprising an outer shielding shell, an insulative housing, and a number of conductive members or foams. The insulative housing defines a number of stacked upper and lower mating ports and a number of receiving slots between the upper and lower ports for receiving the conductive foams. The electrical connector further includes a number of mating modules each having a horizontal ground plate, an upper mating module, and a lower mating module. The upper mating module includes an upper PCB and an upper set of contacts. The lower mating module includes a lower PCB and a lower set of contacts. The ground plate connects with the upper PCB and the lower PCB by another vertical ground plate. The horizontal ground plate extends forward to connect with the conductive foam. This design has two mating modules, which increases the high of the whole electrical connector. Using the horizontal ground plate to connect with the conductive foam also complicates the structure.

An electrical connector having a simple shielding structure is desired.

SUMMARY OF THE INVENTION

Accordingly, an object of the present invention is to provide an electrical connector having a simple shielding structure.

In order to achieve the object set forth, the invention provides an electrical connector including: a shielding shell; an insulative housing received in the shielding shell, the insulative housing having two rows of mating ports in a vertical direction and a receiving slot between the two rows of mating ports; a contact module mounted in the insulative housing, the contact modules comprising an inner circuit board and a plurality of mating contacts mounted on an upper surface and a lower surface of the inner circuit board, the inner circuit board comprising a conductive area at a front end thereof; and a conductive foam received in the receiving slot and compressed between the conductive area of the inner circuit board and the shielding shell.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
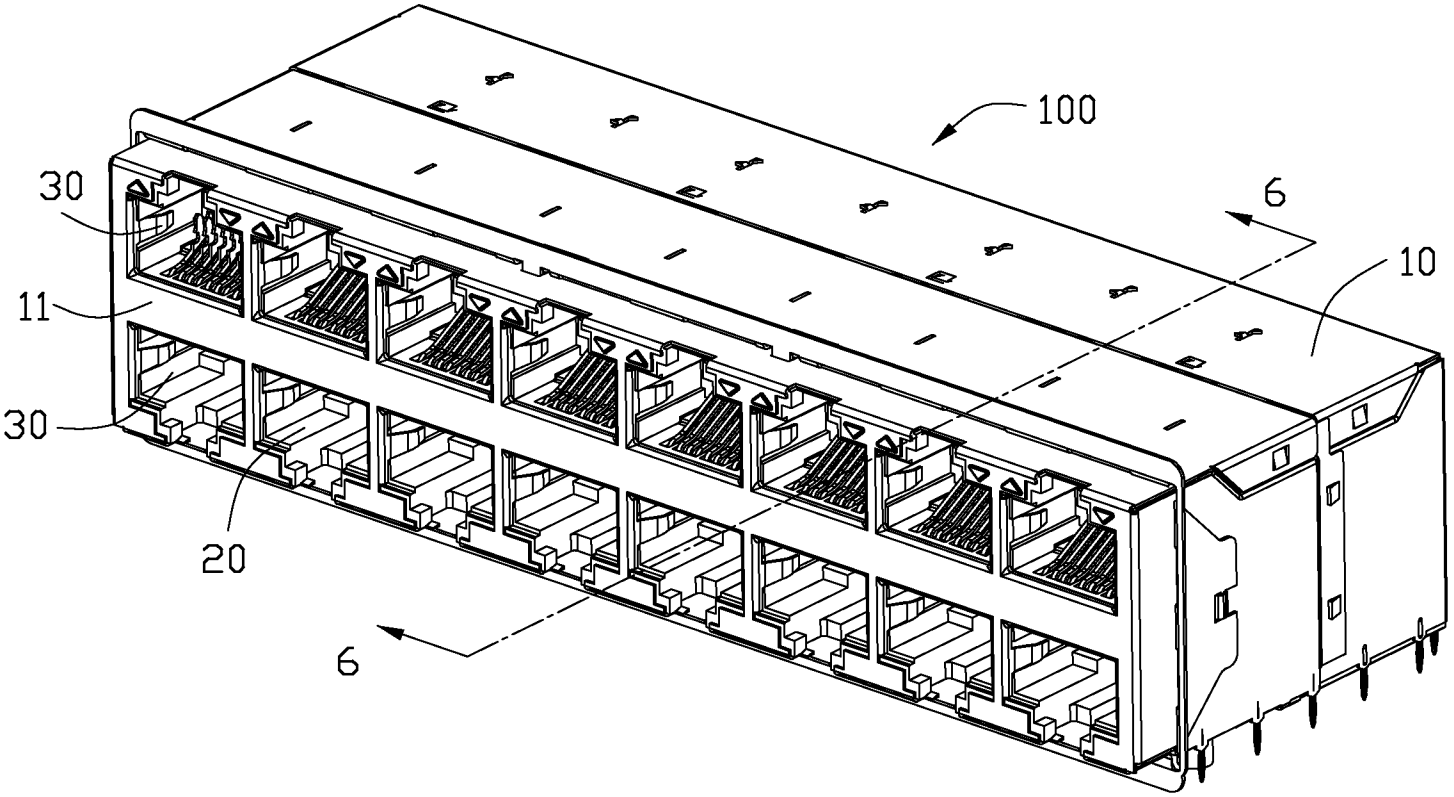
FIG. 1 is a perspective view of an electrical connector according to the present invention.

Referring to FIG. 1, a 2×N-ports electrical connector 100 according to the present invention is to be mounted on an outer circuit board. The electrical connector 100 includes a shielding shell 10, an insulative housing 20 received in the shielding shell 10. The shielding shell 10 is used for shielding electrical magnetic interference (EMI) from exterior environment. Both the shielding shell 10 and the insulative housing 20 have two rows of mating ports 30 in a vertical direction for receiving plug connectors. The shielding shell 10 comprises a number of contact sections 11 disposed between the two rows of mating ports 30.

Figure 2:
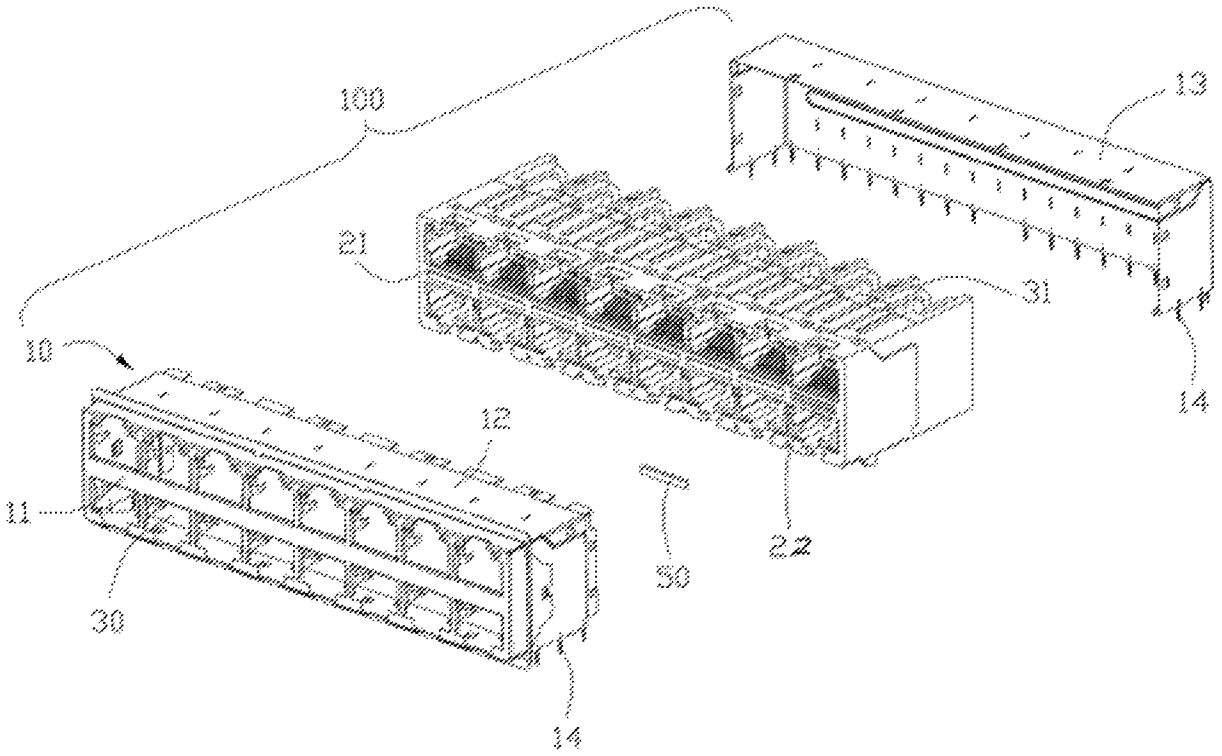
FIG. 2 is a partly exploded view of the electrical connector as shown in the FIG. 1.
Figure 3:
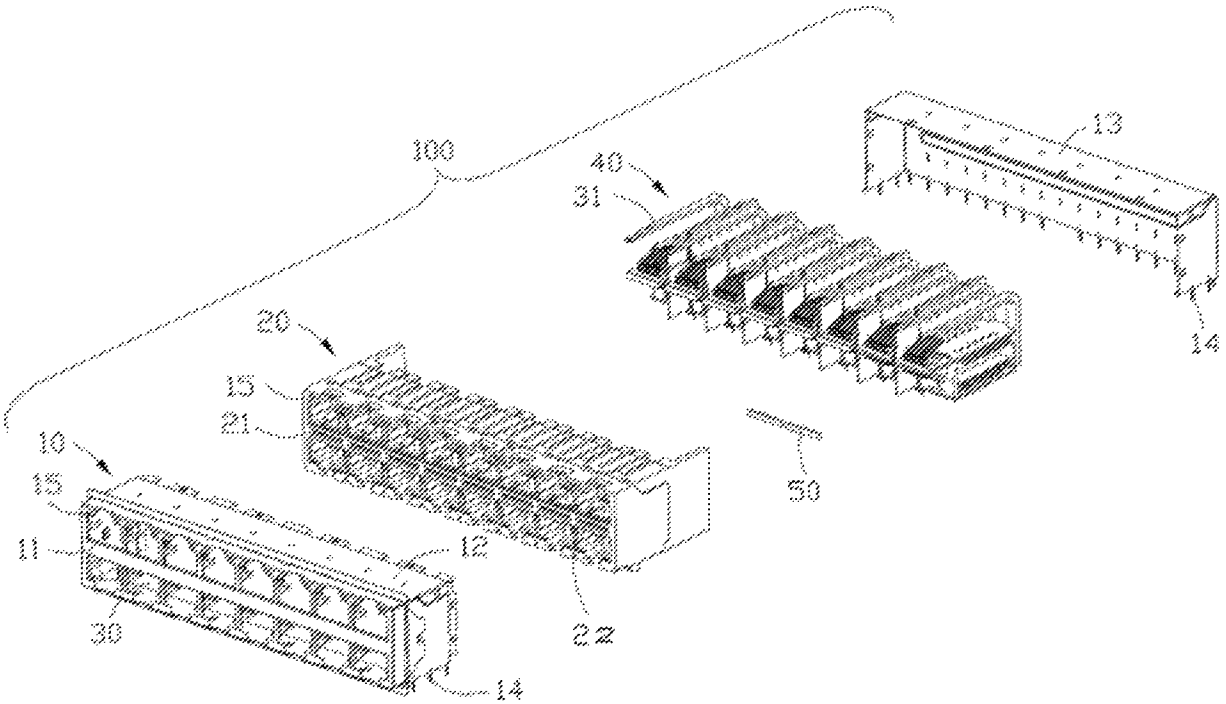
FIG. 3 is a further exploded view of the electrical connector as shown in FIG. 2.

Referring to FIGS. 2 and 3, the electrical connector 100 further includes a number of contact modules 40 received in the insulative housing 20. The insulative housing 20 includes a mating face 21 having a number of receiving slots 22 between the two rows of mating ports 30. For reducing EMI and crosstalk of the adjacent mating ports 30, the electrical connector 100 comprises a number of conductive foams 50 received in the receiving slots 22. The conductive foam 50 is elastic, soft, and/or can be flexibly squeezed. The conductive foam 50 extends beyond the insulative housing 20 before the insulative housing 20 is mounted in the shielding shell 10. When the insulative housing 20 is mounted in the shielding shell 10, the conductive foams 50 are squeezed by the contact sections 11 of the shielding shell 10.

The shielding shell 10 has a shell body 12 and a back cover 13 mounted on the rear end of the shell body 12. The edge of the bottom of the shielding shell 10 defines a number of mounting tails 14 for mounting on the outer circuit board. The electrical connector 100 further includes a number of light pipes 31 extending along the front-to-back direction. Each of the shielding shell 10 and the insulative housing 20 defines a number of small holes 15. The light pipes 31 extend into the holes 15.

Figure 4:
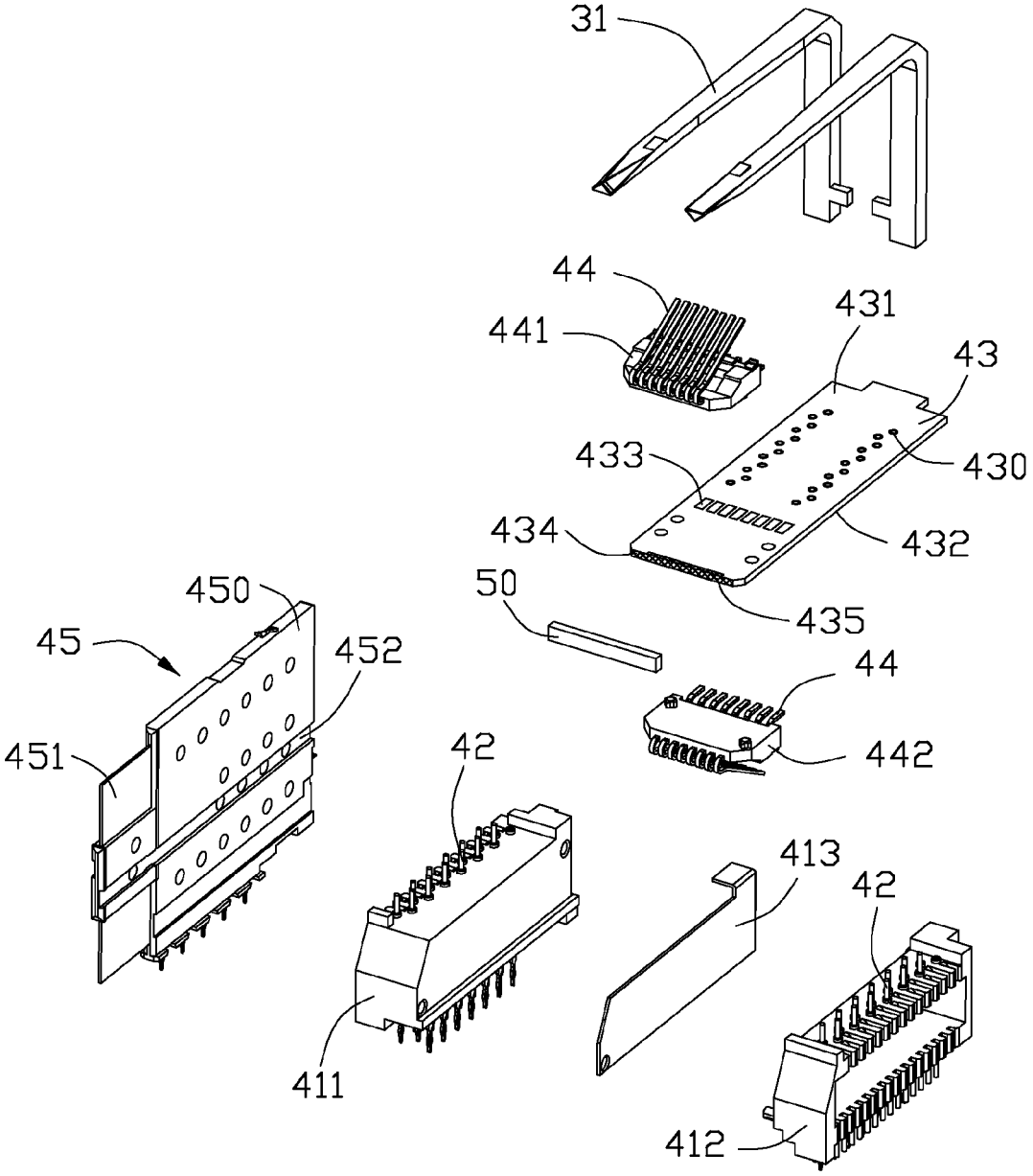
FIG. 4 is an exploded view of one of the contact modules of the electrical connector as shown in FIG. 3.
Figure 5:
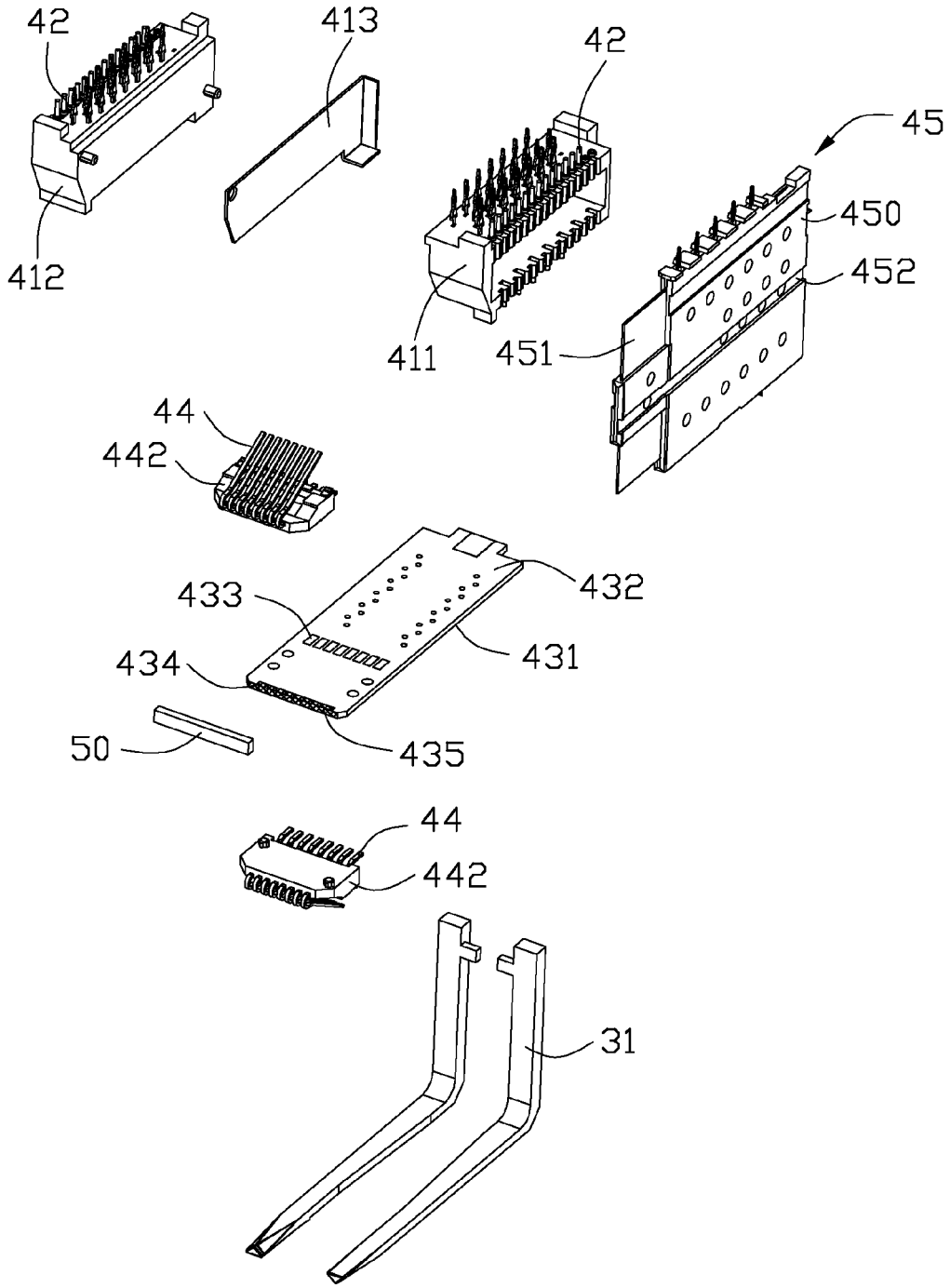
FIG. 5 is an another exploded view of the one contact module of the connector as shown in FIG. 4.

Referring to FIGS. 4-5, each contact module 40 includes a first base 411, a second base 412, a number of transfer terminals 42 fixed by the first base 411 and the second base 412, an inner circuit board 43 mounted on the two bases 411,412, and a shielding blade 413 electrically connecting with the inner circuit board 43 between the first base 411 and a second base 412. Both of the bases 411,412 has a cavity for receiving a number of magnetic coils. The inner circuit boards 43 defines a number of mounting holes 430 for the transfer terminals 42 to pass through to achieve electrical connection with an outer circuit board. The inner circuit board 43 includes an upper surface 431, a lower surface 432, and a front end 434 extending to the mating face 21 of the insulative housing 20. The front end 434 has a conductive area 435 for electrically connecting with the conductive foam 50. The conductive area 435 extends from the front end 434 to the upper surface 431 and the lower surface 432. The conductive area 435 is structured as copper foil. The conductive area 435 connects with a ground layer inside the inner circuit board 43.

The contact module 40 further includes a number of mating contacts 44 mounted on the inner circuit boards 43, a first holding block 441 mounted on the upper surface 431, and a second holding block 442 mounted on the lower surface 432. The inner circuit board 44 includes a number of conductive pads 433 on the upper surfaces 431 and the lower surface 432. The mating contacts 44 electrically connect with the conductive pads 433 on the same surface. The mating contacts 44 are fixed by the first holding blocks 441 on the upper surfaces 431. The other mating contacts 44 are fixed by the second holding block 442 on the lower surface 432. The electrical connector 100 further includes a number of shielding wafers 45. The shielding wafer 45 is vertically mounted between the adjacent mating ports 30 in a transverse direction. The shielding wafer 45 includes an insulative body 450 and a metal plate 451 held in the insulative body 450. The insulative body 450 comprises a groove 452. An edge of the inner circuit board 43 is mounted in the groove 452 for holding the inner circuit board 44.

Figure 6:
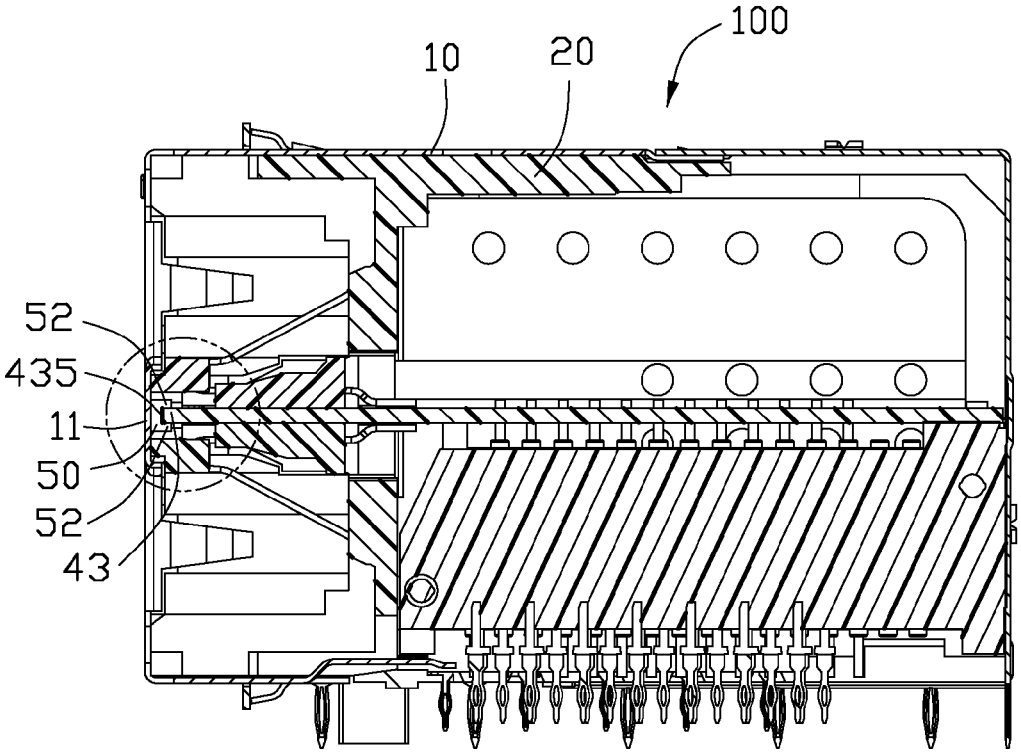
FIG. 6 is a cross-sectional view of the electrical connector taken along line 6-6 of FIG. 1.
Figure 7:
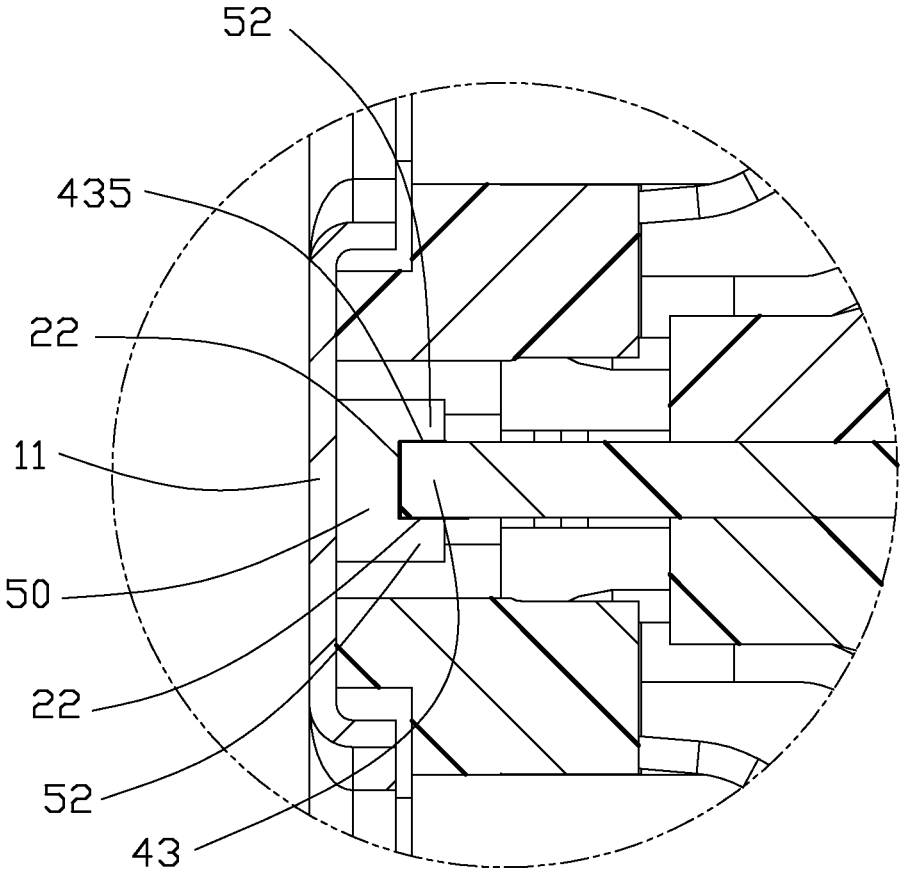
FIG. 7 is an enlarged view of the circle in FIG. 6.

Referring to FIGS. 6-7, when the insulative housing 20 is mounted in the shielding shell 10, the conductive foam 50 contacts with the conductive area 435 in the front end 434 of the inner circuit board 43 and the contact section 11 of the shielding shell 10. The shielding shell 10 is to be electrically connected with the ground pole of the outer circuit board. Since the conductive foam 50 is compressed between the inner circuit board 43 and the shielding shell 10, edge portions 52 of the conductive foams 50 beyond the upper and lower surfaces of the inner circuit boards 43 are so deformed as to contact with the conductive area 435 on the upper surface 431 and the lower surface 432 of the inner circuit board 43.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a shielding shell;

an insulative housing received in the shielding shell, the insulative housing having two rows of mating ports in a vertical direction and a receiving slot between the two rows of mating ports;

a plurality of contact modules mounted in the insulative housing, each of the contact modules comprising a one-piece inner circuit board and a plurality of mating contacts mounted on an upper surface and a lower surface of the inner circuit board, the inner circuit board comprising a conductive area at a front end thereof; and a conductive foam received in the receiving slot and compressed between the conductive area of the inner circuit board and the shielding shell.

2. The electrical connector as claimed in claim 1, wherein the conductive area extends from the front end to the upper surface and the lower surface of the inner circuit board.

3. The electrical connector as claimed in claim 1, wherein the conductive foam extends forwardly beyond the insulative housing before the insulative housing is mounted in the shielding shell.

4. The electrical connector as claimed in claim 1, wherein the inner circuit board comprises a plurality of conductive pads on the upper surface and the lower surface, the mating contacts electrically connected with the conductive pads, respectively.

5. The electrical connector as claimed in claim 4, wherein the contact module comprises a first holding block mounted on the upper surface and a second holding block mounted on the lower surface, some of the mating contacts fixed by the first holding block, and the other of the mating contacts fixed by the second holding block.

6. The electrical connector as claimed in claim 1, wherein the contact module comprises a base and a plurality of transfer terminals secured to the base, and the inner circuit board has a plurality of mounting holes receiving the transfer terminals.

7. The electrical connector as claimed in claim 6, wherein the base comprises a first base and a second base, and the contact module comprises a shielding blade disposed between the first base and the second base.

8. The electrical connector as claimed in claim 1, further comprising a shielding wafer, and wherein each row of the mating ports comprises at least two mating ports, the shielding wafer disposed between the at least two mating ports.

9. The electrical connector as claimed in claim 8, wherein the shielding wafer defines a groove, and an edge of the inner circuit board is received in the groove.

10. An electrical connector comprising:

an insulative housing defining a mating cavity forwardly communicating with an exterior along a front-to-back direction via a front opening in a front face of the housing;

a plurality of contacts disposed in the housing with contacting sections extending into the mating port;

a metallic shell enclosing the housing and including a front plate covering the front face of the housing except the front opening;

a one-piece internal printed circuit board horizontally positioned within the housing with a conductive front edge region located beside the mating cavity and adjacent to the front face of the housing;

a deformable conductive element sandwiched and compressed between the front plate and the conductive front edge region.

11. The electrical connector as claimed in claim 10, wherein the contacts are integrally formed within an insulator mounted upon said internal printed circuit board.

12. The electrical connector as claimed in claim 10, wherein said deformable conductive element is compressible along at least the front-to-back direction.

13. The electrical connector as claimed in claim 10, wherein said deformable conductive element contacts the conductive front edge region in a vertical direction perpendicular to said front-to-back direction.

14. The electrical connector as claimed in claim 10, wherein said deformable conductive element extends along a transverse direction perpendicular to said front-to-back direction.

15. The electrical connector as claimed in claim 14, wherein said deformable conductive element contacts the conductive front edge region along said transverse direction with a length of said deformable conductive element.

16. The electrical connector as claimed in claim 10, wherein said deformable conductive element is of a foam type.

17. The electrical connector as claimed in claim 16, wherein said deformable conductive element is rectangular with a length extending along a transverse direction perpendicular to said front-to-back direction.

* * * * *